United States Patent [19]

Katz

[11] Patent Number: 4,784,297

[45] Date of Patent: Nov. 15, 1988

[54] BEVERAGE DISPENSER WITH AGITATOR

[76] Inventor: Solly Katz, P.O. Box 78036, Sandton, 2146, Transvaal, South Africa

[21] Appl. No.: 24,083

[22] Filed: Mar. 10, 1987

[30] Foreign Application Priority Data

Mar. 10, 1986 [ZA] South Africa ..... 86/1737

[51] Int. Cl.[4] ..... B67D 5/06

[52] U.S. Cl. ..... 222/161; 222/185; 222/641; 366/211; 366/239

[58] Field of Search ..... 222/641, 640, 160, 161, 222/164, 196, 185; 366/209–213, 215, 239, 274, 325, 605; 354/327; 99/275

[56] References Cited

U.S. PATENT DOCUMENTS

| | | | |
|---|---|---|---|
| 1,960,640 | 5/1934 | Lajeunesse | 366/215 |
| 1,997,400 | 4/1935 | Wysocki | 366/211 |
| 2,450,885 | 10/1948 | Erdle | 366/211 X |
| 2,494,866 | 1/1950 | Fressola | 366/210 |
| 2,718,985 | 9/1955 | Tamminga | 222/185 X |
| 3,362,692 | 1/1968 | Iannone et al. | 366/325 X |
| 3,499,578 | 3/1970 | O'Neal | 222/161 X |
| 3,503,592 | 3/1970 | Taylor, Sr. et al. | 366/212 |
| 3,671,020 | 6/1972 | Krup | 222/129.4 X |
| 3,735,964 | 5/1973 | Lorenzen | 366/211 |
| 3,888,466 | 6/1975 | Sedam | 222/335 X |
| 3,934,758 | 1/1976 | Kipp | 222/131 X |
| 4,026,531 | 5/1977 | Luchsinger et al. | 366/211 |
| 4,265,376 | 5/1981 | Skidell | 222/189 |
| 4,343,630 | 8/1982 | Grant | 55/110 |
| 4,422,768 | 12/1983 | Solomon | 366/110 |
| 4,428,507 | 1/1984 | Sneider | 222/105 |

FOREIGN PATENT DOCUMENTS 2137962 10/1984 United Kingdom .

*Primary Examiner*—Kevin P. Shaver

*Attorney, Agent, or Firm*—Birch, Stewart, Kolasch & Birch

[57] ABSTRACT

A fluid dispenser for dispensing beverages which include a drive device, a disturbing device and a holder for holding a container from which fluid is to be dispensed. The drive device and disturbing device operate to rock or agitate the holder to cause liquid in the container to mix with itself. This prevents the liquid from stratifying and from solids settling. Preferably the container is in the form of a collapsible bag which collapses as liquid is dispensed. An outlet from the container is controlled by a dispensing device.

17 Claims, 4 Drawing Sheets

BEVERAGE DISPENSER WITH AGITATOR

INTRODUCTION

This invention relates to a fluid dispenser and more particularly although not exclusively to a fluid dispenser suitable for dispensing pre-mixed beverages such as fruit juices, soups and the like which have a tendency to stratify if left undisturbed for any significant period of time.

BACKGROUND TO THE INVENTION

Post-mix beverages are generally supplied to the point of sale in concentrated form and are mixed in a container mounted on or connected to a dispenser. Pre-mix beverages are simply poured into the container ready for dispensing. This is known as an open ended system. Any beverage which has a tendency to separate or stratify must be agitated prior to being dispensed. Conventional open ended systems use, for example, an impellor, a paddle wheel or pump circulation to effect the agitation and prevent sedimentation. Such systems are described in U.S. Pat. Nos. 4,610,145, 3,664,643 and 4,008,832.

One serious problem with the aforementioned systems is that the beverages must be decanted into the mixing container in the dispenser. To ensure that bacteria and the like do not effect the quality of the beverage it is important that the container and agitating means are cleaned and sterilized regularly. In practice this is often not done and, particularly where a beverage remains in the mixing container for long periods, the quality of the beverage suffers. In fact, by simply decanting the beverage from the sealed and sterilized container in which it is is supplied, the beverage comes into contact with the ambient atmosphere and hence any bacteria which might be present therein. To counter this problem, most beverage suppliers add preservatives to their beverages in order to improve the shelf life of the beverages.

Many people object to the presence of preservatives in their beverages. It is known to supply naturally preserved fruit juices and like beverages in "bag-in-box" type containers which include a collapsible bag which is designed to collapse as the beverage is dispensed. This could be called a closed system. A major advantage of this sytem is that no air is brought into contact with the beverage during dispensing resulting in a far longer shelf life. Clearly, this principle is unsuited for prior art pre-mix commercial dispensers where the beverage to be dispensed is not homogeneous, as the necessary agitators cannot be brought into contact with the liquid. The stratification of the liquid will result in a variation of the consistency of the dispensed beverage.

It is accordingly an object of this invention to provide a fluid dispenser with which the aforementioned problems may be overcome or at least minimised.

SUMMARY OF THE INVENTION

According to the invention there is provided a fluid dispenser comprising a holder adapted to hold a fluid container in a manner which allows fluid to be dispensed from the container, disturbing means for disturbing the container mechanically while it is so held, and drive means for driving the disturbing means so that the fluid inside the container mixes with itself in use.

The holder may take any convenient form and its form will depend on the type and form of container to be used. In one embodiment the holder is in the form of a cradle adapted to receive containers in the form of a flexible bag. The cradle may have one or more openings in the base thereof through which a conduit may be passed to connect the container or containers with an outlet from the dispenser. Where the container is rigid, the holder may comprise a bracket or clamp adapted to secure around or to the container.

The disturbing means in the preferred form of the invention comprises an assemblage of linkages arranged to impart a rocking motion to the holder to thereby rock the container held in or by the holder. The assemblage of linkages may comprise a rocker arm pivotally mounted to a support structure for the dispenser, one end of the rocker arm being connected to or linked to the holder and the other end being driven by the drive means.

Another possible form of disturbing means envisaged includes a reciprocally movable arm arranged to intermittently exert a force onto a side wall of the container. The container wall will need to be flexible for this system to operate.

It has been found that mixing is most effective where a to and fro wave motion can be set up in the liquid in the container. This to and fro motion is easily activated-by repeatedly tilting one side of the container or by moving the container back and forth.

Other disturbing means envisaged include a vibrator for causing a vibrational type movement to the container, or a rotator for rotating the holder and container.

The drive means employed will depend on the disturbing means employed. One suitable drive means envisaged includes an electric motor with a cam type drive arrangement which will be linked to the disturbing means to provide the constructing means with a reciprocal movement.

Pneumatic or hydraulic drive means may also be used.

The drive means may have a speed control connected thereto and a timer switch to provide for intermittant operation.

Further features of the invention provide for at least the holder to be housed within a thermally insulated cabinet. The cabinet may have a cooling or heating facility associated therewith to maintain the temperature within the cabinet at a predetermined level.

Some form of dispensing device will preferably be associated with the dispenser. The dispensing device may include a spring loaded bar adapted to clamp a flexible outlet conduit from the container to shut off the flow through the conduit in use. A press lever will be provided for releasing the spring loaded bar.

BRIEF DESCRIPTION OF THE DRAWINGS

Embodiments of the invention are described below by way of example, reference being made to the accompanying drawings in which.

DETAILED DESCRIPTION OF PREFERRED EMBODIMENTS

Figure 1:
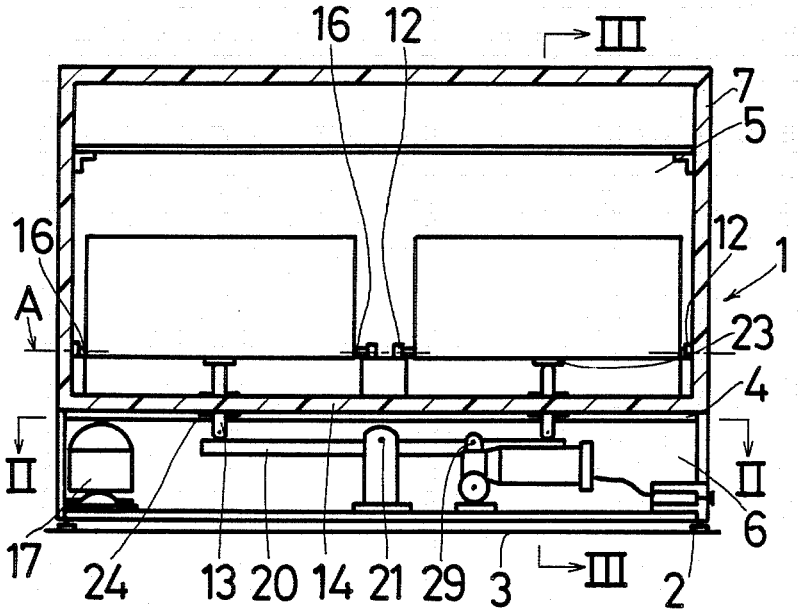
FIG. 1 shows a cross-sectional rear view of a dispenser according to the invention.
Figure 2:
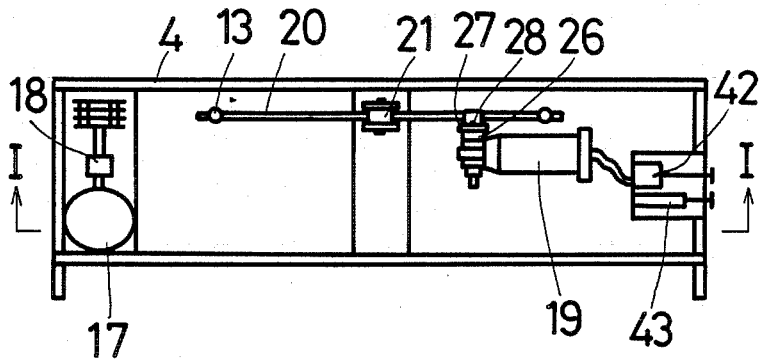
FIG. 2 shows a plan view of the dispenser, along line II—II of FIG. 1.
Figure 3:
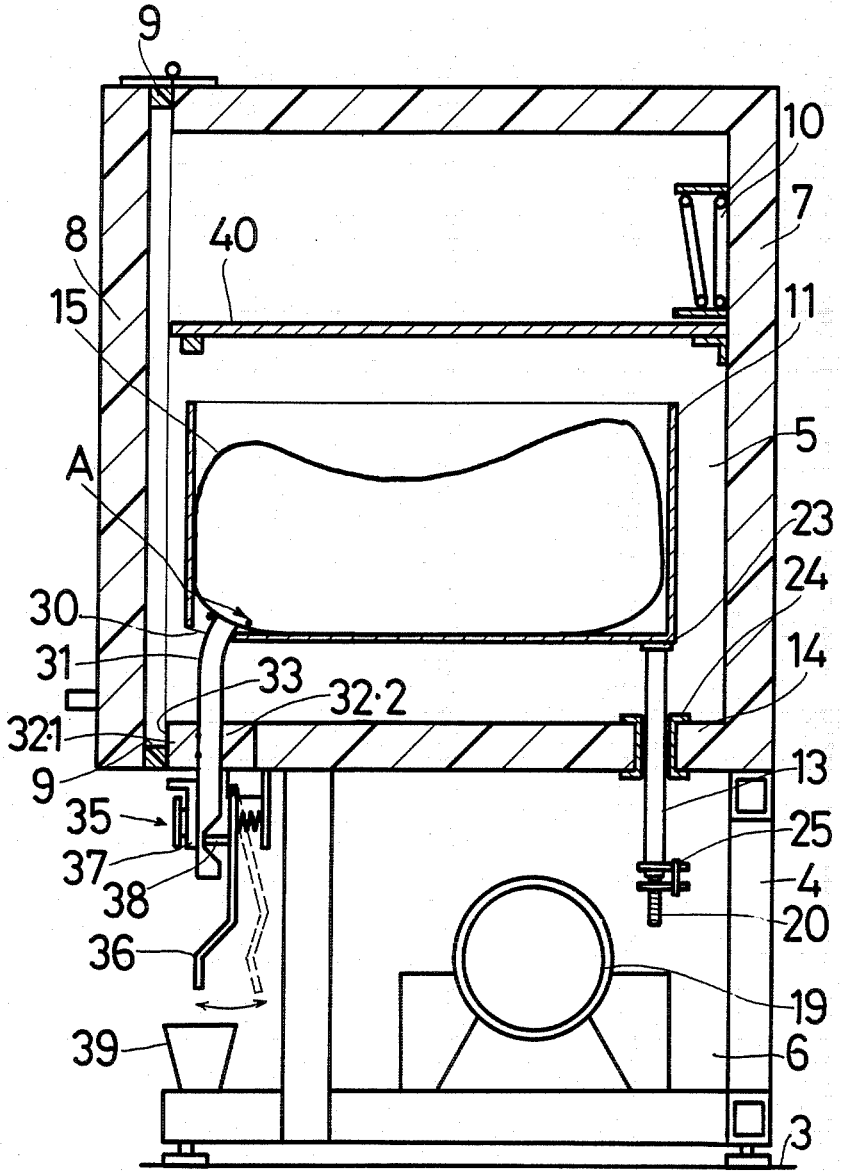
FIG. 3 shows a cross-sectional side view of the dispenser along the line III—III of FIG. 1.

Referring in detail to FIGS. 1 to 3, there is illustrated a dispenser 1 having adjustable feet 2 standing on a support surface 3. The dispenser is constructed around a support frame 4 and generally comprises an upper cabinet 5 and a lower cabinet 6.

The upper cabinet 5 has walls 7 formed of a thermally insulating material which serves to insulate the interior of the upper cabinet 5 from the ambient air. A top hinged door 8 forms a front wall to the cabinet, the door having a seal 9 around its periphery. The door 8 is also formed from an insulating material. Refrigeration coils 10 are located within the upper cabinet to ensure that the air temperature within the upper cabinet can be maintained at a preselected level.

A pair of box-like cradles 11 are housed within the upper cabinet. These cradles are pivotally mounted to the support frame through pivotal mounts 12 fitted to the support frame. Stub axles 16 which project laterally out of the lower front of each side of each cradle 11 are engaged with the pivotal mounts 12. Each cradle is thus able to pivot relative to the dispenser about an axis of rotation coincident with the axis of the axles 16. The axis of rotation is indicated by letter 'A' in FIGS. 1 and 3. The rear of the cradles are supported on the upper ends of push-rods 13 which project through the base 14 of the upper cabinet and are manipulated by disturbing means more fully described herebelow. Liquid to be dispensed is situated in containers located in these cradles. In the preferred form of this invention the containers are flexible bags 15 which collapse as liquid is dispensed obviating the need to vent the bag during dispensing. An outlet conduit 31 from each bag passes through an opening in the base of the cradle and through a dispensing control valve 35 which will be described more fully herebelow.

The lower cabinet 6 houses the motors and much of the mechanics of the dispenser. A refrigeration compressor 17 and the motor 18 therefor are mounted to the support frame 4 within this lower cabinet. A second motor 19 for driving the disturbing means is also mounted to the support frame. This second motor 19 is a variable speed motor having a timer device 42 and speed control device 43 associated therewith to enable the motor to be driven for preselected periods of time at preselected speeds.

The disturbing means comprises a rocker arm 20 pivotally mounted to the support frame 4 through a pivotal mount 21. The pivotal mount 21 is located approximately centrally along the length of the rocker arm. To each free end of the rocker arm a push rod 13 is connected, the push rods 13 extending up through the base of the upper cabinet and bearing against a bearing plate 23 situated underneath and towards the rear of each cradle 11. A suitable sliding bearing 24 will be provided in the base 14 of the upper cabinet to ensure a sealed and substantially frictionless movement for each push rod. An articulated connection 25 is provided between the lower end of each push rod 13 and the end of the rocker arm.

The second motor 19 for driving the rocker arm is connected to the rocker arm through a gear box 26 and a cam wheel 27. An off-centre pin 28 on the cam wheel is linked to the rocker arm 20 by means of a rigid link 29. As the cam wheel rotates, the rocker arm 20 will be caused to rock in a vertical plane resulting in the push rods 13 moving up and down and hence the cradles moving up and down about their pivots 12.

It will be appreciated that this rocking of the cradles will cause liquid in containers located in the cradles to flow back and forth in a wave like motion resulting in a thorough mixing of the liquid within each container. Experiment has shown that optimum mixing occurs when the cam wheel is rotated at about 100–105 revolutions per minute. Generally, initial mixing may require a rotational speed slightly in excess of this figure, but once mixing has taken place the speed may be dropped off without the liquids separating into different strata.

Figure 4:
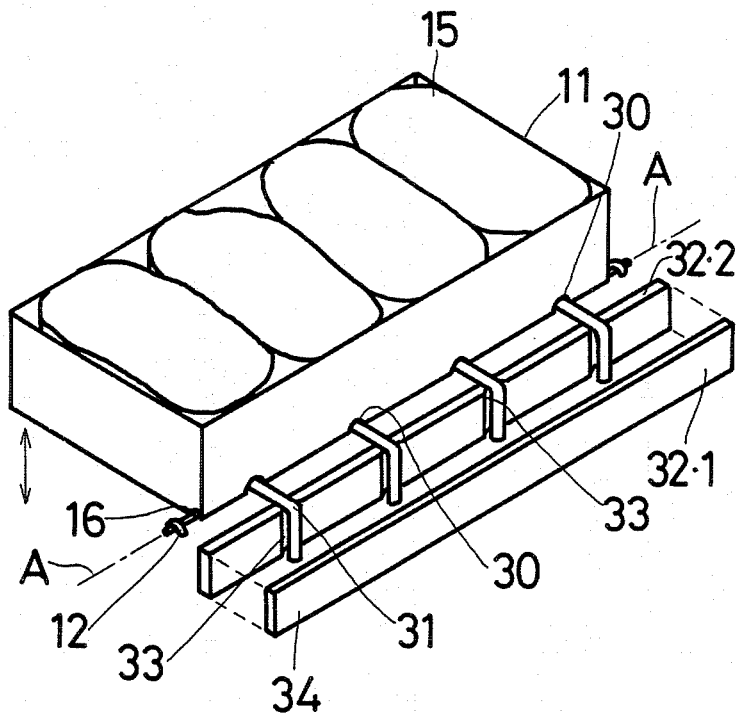
FIG. 4 shows a perspective view of a cradle for holding a plurality of containers from which beverages may be dispensed.

As shown in FIG. 4, each cradle 11 is of rectangular box like construction having an open top. Each cradle has, in the front lower edge thereof, four openings 30 through which pass the supply conduits 31 from the containers located within the cradle. The conduits 31 are flexible and are able to withstand the continual rocking of the cradle without rupturing. It is considered important that the cradle has sufficient depth (i.e. measured in a horizontal direction perpendicular to the pivot axis) for containers 15 to lie with their longest dimension substantially horizontal and perpendicular to the pivot axis. It has been found that this provides the best mixing action.

The conduits 31 from each container pass through the openings 30 and down through a specially shaped beam 32 which defines the forward edge of the base 14 to the upper cabinet. The beam 32 is formed in two parts, namely a forward part numbered 32.1 and a rearward part numbered 32.2. When the door 8 is open the forward part 32.1 can be detached from the rearward part 32.2. The rearward part 32.2 of the beam 32 has four rounded vertically aligned slots 33 which align with the openings 30 in the cradle. The door 8 seals against the forward face 34 of the forward part of the beam. Thus, when the door is open, and the forward part removed, a conduit can be removed from its rounded slot and the associated container can be removed from the cradle 11 and be replaced with a fresh container.

The lower end of each conduit 31 is shut-off by means of a dispensing device 35 as shown in FIG. 3. Each dispensing device 35 has a pivotally mounted plate 36 spring biased towards an anvil 37. A bar 38 on the plate is positioned to engage the conduit and crimp the conduit between the bar and anvil. This will provide an effective shut-off for the conduit and will ensure that no bacteria or the like is able to ingress into the container through the conduit. Dispensing of liquid takes place by pushing the plate away from the conduit allowing the liquid to dispense under the action of gravity into a cup 39 or other recepticle.

In use, pre-mixed beverages, such as fruit juice or the like will be supplied in a sealed container of the type used as "bag-in-box" type flexible bags. Preferably the bag will have a conduit therefor pre-fitted thereto. Alternatively the conduit can be inserted into an appropriate female connector just prior to dispensing. The entire bag will have been sealed and packaged under sterilized conditions and will preferably have been stored and transported in a frozen condition. Natural fruit juice, if properly prepared and frozen, can be kept for periods of up to six months when frozen. The frozen juice will then be allowed to thaw before it is dispensed. For this purpose, the upper cabinet has a shelf 40 situated above the cradles on which frozen back-up containers may be located prior to dispensing. Generally the temperature inside the upper cabinet will be maintained at 4° C. The gradual thawing of the liquid of the back-up containers within the cabinet will enable the temperature within the cabinet to be maintained at 4° C. without the refrigeration apparatus being utilized. This will lead to an energy saving.

When a container is to be replaced, the empty container will be removed from the cradle and a fresh, thawed container placed in position in the cradle. During change over the disturbing means will be switched off. The conduit from the fresh container will be passed through the slot 33 in bar 32 and down through the dispensing device 35. Once in position, a seal on the free end of the conduit may be broken and agitation and dispensing may commence. Clearly it will be advantageous if a seal on the conduit is only broken after the container is properly located in position. This will ensure that the beverage as dispensed will not have come into contact with the air at any stage after packaging. Such an arrangement will also minimise the chances of the contents of the container being tampered with prior to the beverage being dispensed.

It is envisaged that because it is possible to dispense the beverage without air coming into contact with the liquid prior to dispensing, and because the beverage is maintained at 4° C., the shelf life of the beverage once it has been located in the dispenser will be long. This will mean that fresh fruit juice can be dispensed economically as wastages that occur in present open ended systems will not occur with the dispenser of the present invention.

Figure 5:
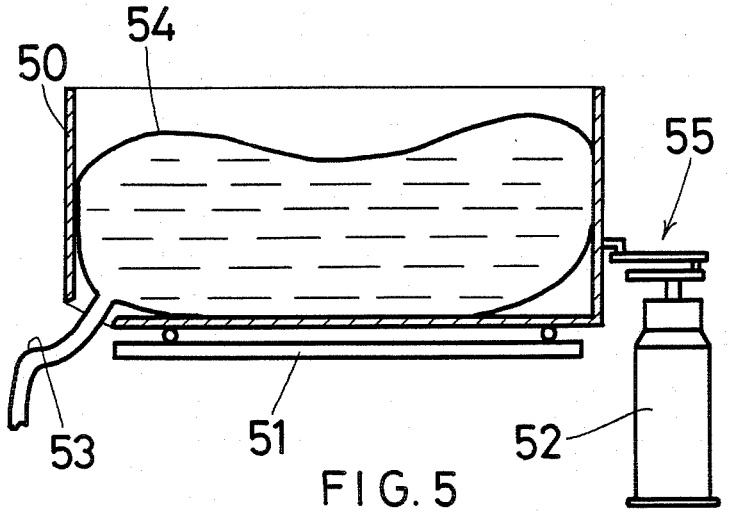
FIG. 5 shows diagrammatically in side elevation, an alternative embodiment of disturbing means for disturbing containers in the dispenser.

Clearly the disturbing means may take a different form from that described above. In the embodiment shown diagrammatically in FIG. 5 the disturbing means comprises an arrangement similar to that shown in FIGS. 1 to 4, but in place of the lifting mechanism described previously, the mechanism in this example is a to and fro mechanism. The cradle 50 rides on rails 51 and the cam arrangement 55 on the drive motor 52 moves the cradle back and forward in a horizontal direction. The conduits 53 leading from the containers 54 to the dispensing outlets will have a looped configuration providing sufficient slack to accomodate the movement of the cradle.

Figure 6:
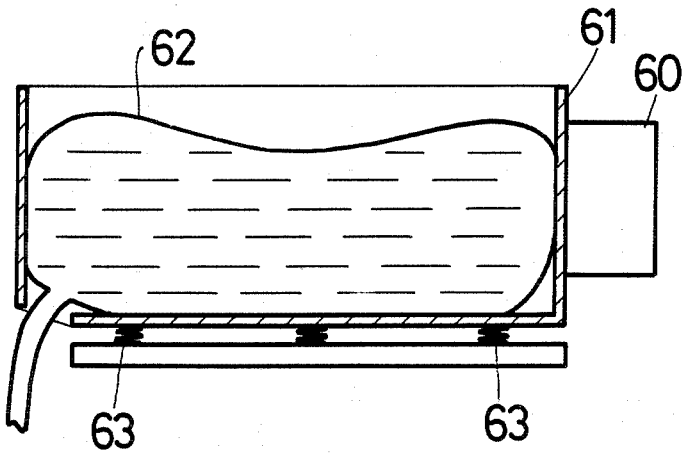
FIG. 6 shows diagrammatically in side elevation, a further alternative embodiment of disturbing means for disturbing containers in the dispenser.

Another alternative, shown in FIG. 6, is simply to mount a small eccentrically weighted motor vibrator 60 onto the cradle 61 thus providing agitation for the containers 62. The cradle 61 will then be mounted on suitably resilient footings 63 to allow for the necessary movement of the cradle.

Figure 7:
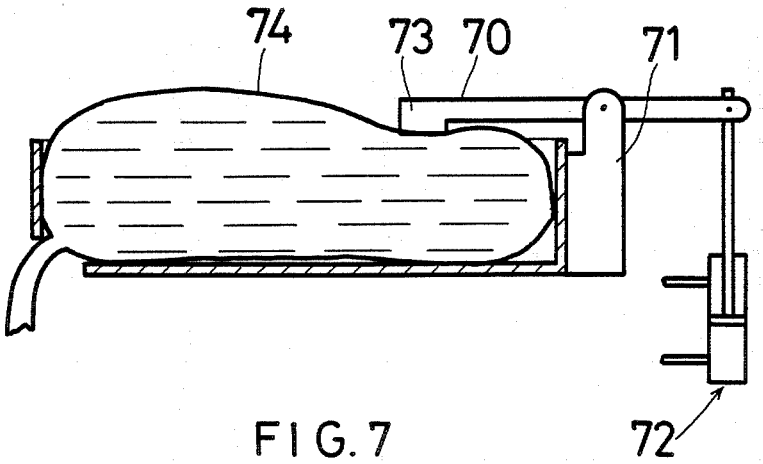
FIG. 7 shows diagrammatically in side elevation, a still further alternative embodiment of disturbing means for disturbing containers in the dispenser.

In a still further alternative, shown in FIG. 7, an arm 70 pivotally mounted to a support bracket 71 is driven by a pneumatic piston and cylinder drive mechanism 72. The free end 73 of the arm acts to depress the flexible wall 74 of the container to thereby agitate the contents of the container. The free end 73 of the arm 70 may alternatively be clamped to the container wall 74 to cyclically lift and lower the container and thereby set up a wave motion in the liquid in the container.

It will also be understood that it is not necessary to limit this invention to the agitation of fruit juices within a refrigerated compartment. Clearly other liquids may be dispensed using the basic idea of external agitation. Specifically envisaged are beverages such as soups and the like which would have a tendency to settle into different layers but which would preferably be dispensed hot. Such beverages could be packaged in sealed containers, agitated prior to dispensing, and heated either after or prior to dispensing.

It is not essential for the beverages to be dispensed in a closed system from collapsible containers as described herein although this is a preferred form of the invention. Vented containers may be employed. One advantage of the agitation devices disclosed herein is that pumping or circulating equipment which has heretofor been employed for agitation but which must regularly be cleaned and sterilized is no longer necessary. The agitation equipment described herein never comes into contact with the liquid itself and thus the same degree of sterilization is not required.

It is intended that all matter contained in the above description and illustrated in the drawings will be interpreted as illustrative and not in a limiting sense.

What is claimed is:

1. A fluid dispenser comprising:

a holder having a width and a major dimension extending in a substantially horizontal direction;

a pivotal axis operatively positioned to extend along said substantially horizontal direction of said major dimension at one end of said holder for pivoting said holder;

at least one fluid container operatively positioned to be substantially flat within said holder;

said at least one fluid container having an outlet opening positioned at an aperture of said holder at one end of the fluid container contiguous with said pivotal axis in such a manner as to allow fluid to be dispensed from one side of said fluid container;

and means for disturbing the container in a reciprocal manner about said pivotal axis for discharging fluid therefrom.

2. A fluid dispenser as claimed in claim 1 wherein said disturbing means comprises a mechanism for cyclically tilting said container supported on said holder.

3. A fluid dispenser as claimed in claim 1 wherein said disturbing means comprises a mechanism for repeatedly moving said container back and forth.

4. A fluid dispenser as claimed in claim 1 wherein said disturbing means has a timer associated therewith to provide for intermittent operation.

5. The fluid dispenser as claimed in claim 1, wherein said container is a flexible bag.

6. A fluid dispenser as claimed in claim 1 wherein the disturbing means comprises an assemblage of links driven by a drive means and adapted to impart a rocking motion to said holder.

7. A fluid dispenser as claimed in claim 6 wherein said assemblage of links comprises a rocker arm pivotally mounted to a support structure for said dispenser, one end of said rocker arm being linked to the holder, said rocker arm being driven by said drive means to rock said holder.

8. A fluid dispenser as claimed in claim 1 wherein said holder is housed within a thermally insulated cabinet.

9. A fluid dispenser as claimed in claim 1 wherein a refrigeration means is used to cool the interior of said cabinet.

10. A fluid dispenser as claimed in claim 1 claim wherein a dispensing device is mounted to said dispenser for controlling said outlet opening of said container held by the holder in use.

11. A fluid dispenser as claimed in claim 10 wherein said outlet opening comprises a flexible tube and said dispensing device comprises a spring loaded bar adapted to clamp against the flexible tube and a press lever for releasing the clamp.

12. A fluid dispenser as claimed in claim 1 wherein said holder comprises a cradle adapted to receive said at least one container therein.

13. A fluid container as claimed in claim 12 wherein said cradle has openings in the base thereof for outlet conduits from said containers situated in said cradle.

14. A fluid dispenser as claimed in claim 12 wherein said cradle is pivotally mounted to a support structure for said dispenser and said disturbing means is adapted to rock said cradle about said pivotal axis.

15. A fluid dispenser as claimed in claim 1 wherein drive means comprising an electric motor having a cam type drive arrangement is provided for driving said disturbing means.

16. A fluid dispenser as claimed in claim 15 wherein a gearbox is interposed between said electric motor and said cam type drive arrangement.

17. A fluid dispenser as claimed in claim 15 or 16 wherein said motor is a variable speed motor.

* * * * *